United States Patent [19]

Schiraldo

[11] Patent Number: 4,869,499

[45] Date of Patent: Sep. 26, 1989

[54] TOE EXERCISE DEVICE

[76] Inventor: Donald R. Schiraldo, 84 E. 26th St., Bayonne, N.J. 07002

[21] Appl. No.: 296,973

[22] Filed: Jan. 17, 1989

[51] Int. Cl.[4] ..... A63B 21/12; A63B 23/00

[52] U.S. Cl. ..... 272/137; 272/96; 272/139; 272/903; 128/25 R

[58] Field of Search ..... 272/67, 96, 116, 135, 272/137, 139, 140, 142, 903; 128/25 R; 124/20 R; D22/106

[56] References Cited

U.S. PATENT DOCUMENTS

| | | | |
|---|---|---|---|
| 494,197 | 3/1893 | Hall | 272/67 |
| 2,085,320 | 6/1937 | Kolstrand | 272/142 |
| 2,807,254 | 9/1957 | Stribling | 124/20 R |
| 3,494,346 | 2/1970 | Yount et al. | 124/20 R |
| 4,371,161 | 2/1983 | Williams | 272/96 |

*Primary Examiner*—Richard J. Apley
*Assistant Examiner*—Franklin L. Gubernick
*Attorney, Agent, or Firm*—Gloria K. Koenig

[57] ABSTRACT

A toe exercise device in a form of a dynamic splint is disclosed comprising a semi-circular plastic shell which has an adjustable holding strap attached to the bottom end thereof and fitted with Velcro such that the strap can be adjustably fitted above the ankle of the foot which is being exercised. At the upper or top end of the shell is secured an adjustable stretchable rubber tubing which has at its free end a toe sling or pouch. The plastic shell essentially comprises a brace member which is adapted to fit behind the leg. The toe sling is adapted to fit around the bottom portion of the toe and tends to pull the toe in a direction toward the leg. In this way, the user of the device can exercise his or her tendons which are situated in the vicinity of the toe located in the sling. This dynamic splint will also assist in obtaining passive extension at the metatarsal phalangeal joints. The top part of the shell may be formed at its upper peripheral extremity with an annular opening adapted to have the rubber tubing pass there-through which enables the individual to use a variety of different lengths and tensions depending on the needs of the user of the device.

6 Claims, 3 Drawing Sheets

TOE EXERCISE DEVICEcFIELD OF THE INVENTION

The present invention relates to a toe exercise device and more particularly, to a toe exercise device adapted to assist in obtaining passive extension of the tendons and/or joints in the vicinity of the toe being exercised. The device comprises an elongated semi-circular relatively stiff brace member which is adapted to fit behind the user's leg directly above the ankle and having, at the bottom end thereof, an adjustable holding strap adapted to adjustably fit across the front of the user's ankle to hold the member in place and at the upper end thereof a stretchable flexible tubing which has at its extreme free end a toe sling or pouch adapted to fit around the bottom of the toe being exercised to cause the toe to be pulled toward the user's leg.

DESCRIPTION OF THE PRIOR ART

While the prior art generally discloses a variety of different types of exercise and/or support members for use in exercising injured portions of leg by means of straps fitted with "VELCRO" none of the prior art discloses a toe exercise device according to the present invention. For example, the Williams U.S. Pat. No. 4,371,161 discloses an ankle and foot exercise device including a base plate having adjustable holding straps fitted with "VELCRO" and a stretchable tubing which extends between the foot of the user and the base plate. The tubing attaches to a strap which is connected about the foot area and a support arm is locked in position by means of a locking clip in order to provide tension on the stretchable tubing. The user strengthens his or her ankle and foot muscles by foot motions that are partially restrained by the exercise device. This patent discloses that the exercise device aids in plantar flexing the foot and the stabilization of the first big toe. The Lamb U.S. Pat. No. 4,573,678 shows a backing fitted behind the user's foot, wherein the device is designed for contraction of the foot for stretching tight heel cords. The device comprises a foot support to cause the user's foot to be held in a toe-up position with a platform pivotally connected to a base member. The exercise comprises forcing the foot down against the spring action of the pivot. Another type of exercise device is disclosed by the Kauffman U.S. Pat. No. 4,310,154 comprising a device for exercising the wrist and fingers of an individual's hand. This device is designed to strengthen the hand, wrist and fingers, for example, of a basketball player. A frame-like device is mounted on the arm of the user while the fingers are held in a frame member which holds the hand in an upward angled position relative to the body by means of spring tension. The exercise to strengthen the fingers and the hand comprises lowering the hand against the tension as best illustrated in FIGS. 1 and 3 of the patent. In the Goodman Patent, U.S. Pat. No. 4,304,401, there is disclosed a device for exercising the quadriceps muscles of the legs. These are the muscles which control the action of the knee. The device comprises supporting rods which support a wooden platform which in turn supports the upper portion of the leg. A cross-bar is provided for attaching an elastic band which is tied to the patient's shoe. The patient then raises his or her leg against the tension of the elastic band which causes the quadriceps muscle to be exercised. Mikell U.S. Pat. No. 2,467,943 is adapted to exercise the weakened condition of the lower leg and foot. This device comprises two foot engaging members which are adapted to engage a patient's foot in the area back of the ball of the foot and under the toes respectively. The members are connected by means of chains and a strap fits over the knee. Tension is obtained by means of a pair of coil springs. To operate the exercise device, the patient is seated and moves his or her leg and foot at the ankle point, overcoming tension of the coil springs. The U.S. Pat. No. 4,294,238 of Woodford discloses a device when assists in relaxing the leg muscles after physical activities such as, jogging. This device comprises a strap which is attached by straps above and below the knee and around the middle of the foot. The length of the strap can be adjusted by means of "VELCRO". The device is used for flexing the foot in order to relax the muscles.

The foregoing prior art disclosures are not considered to have disclosed the particular type of toe exercise device disclosed according to the present invention. Thus, these prior art disclosures are deemed to be deficient with respect to the present invention.

SUMMARY OF THE INVENTION

The present invention essentially comprises a dynamic splint for providing assistance in obtaining passive extension of at least the metatarsal phalangeal joints, [i.e., 1st through 5th] and the tendons which are located in the vicinity of, behind and under, the toe being exercised. This splint basically is an exercise device comprising a toe exercise device in a form of a dynamic splint comprising a semi-circular plastic shell which has an adjustable holding strap attached to the bottom end thereof and fitted with a cooperating hook and pile tape sold under the trademark "VELCRO" such that the strap can be adjustably fitted above the ankle of the foot which is being exercised. At the upper or top end of the shell is secured an adjustable stretchable rubber tubing which has a toe sling or pouch at its free end. The plastic shell is essentially a brace member which the holding strap holds in place on the leg. The toe sling is adapted to fit around the bottom portion of the toe and tends to pull the toe in a direction toward the leg. In this way, the user of the device can exercise his or her joints and tendons which are situated in the vicinity of the toe located in the sling. In respect to the big toe, this dynamic splint will assist in obtaining passive extension at the first metatarsal phalangeal joint and at the second through fifth similar joints on the foot for the other toes respectively. The top part of the shell may be formed at its upper extremity with an elongated annular tubular opening adapted to have the rubber tubing pass therethrough which enables the individual to use a variety of different lengths and tensions depending on the needs of the user of the device.

By exercising the tendons in the vicinity of the toe which has been injured, the person will be able to walk in a natural manner after a short time. In addition to stretching the tendons, which for the big toe comprise the flexor hallicus longus and flexor hallicus brevis, the surrounding soft tissue also is exercised. Tendons of other toes also can be exercised if necessary by modifying the strength of elasticity of the tubing. Typically, the device is operated by fitting the toe sling around the underside of the toe which causes the rubber tubing to extend and thus exerts tension pulling the toe back toward the leg of the user. The user exercises the tendons by urging the toe forward away from the body which imposes the tension in the vicinity of the toe. The device may be used in a reclining or sitting position. In addition, the brace member and tubing can be made in a variety of sizes, e.g., small, medium and large, to accommodate different individual's needs. The tubing also can be of variable flexibility. The thickness and strength of the tubing can be modified depending on the size of the individual's toes and the individual's strength. Since it is replaceable, one can use either soft, medium or hard tension tubing depending of the needs and strength of the user and the toe being exercised.

An object of the present invention is to provide a toe exercise device in the form of a dynamic splint which is economical and reliable for use in exercising the tendons in the vicinity of the toe.

Another object of the present invention is to provide a toe exercise device to assist in obtaining passive extension of the joint in the vicinity of the toe.

A further object of the this invention is to provide a toe exercise device which comprises a semi-circular brace member having at the bottom end adjustable holding straps and at the top end thereof flexible tubing which has on its extremity a sling or pouch adapted for receiving the toe to be exercised.

These and other objects and advantages of the present invention will become apparent from the following description of the preferred embodiment of the present invention when considered in conjunction with the accompanying drawings.

DESCRIPTION OF THE PREFERRED EMBODIMENT

Figure 1:
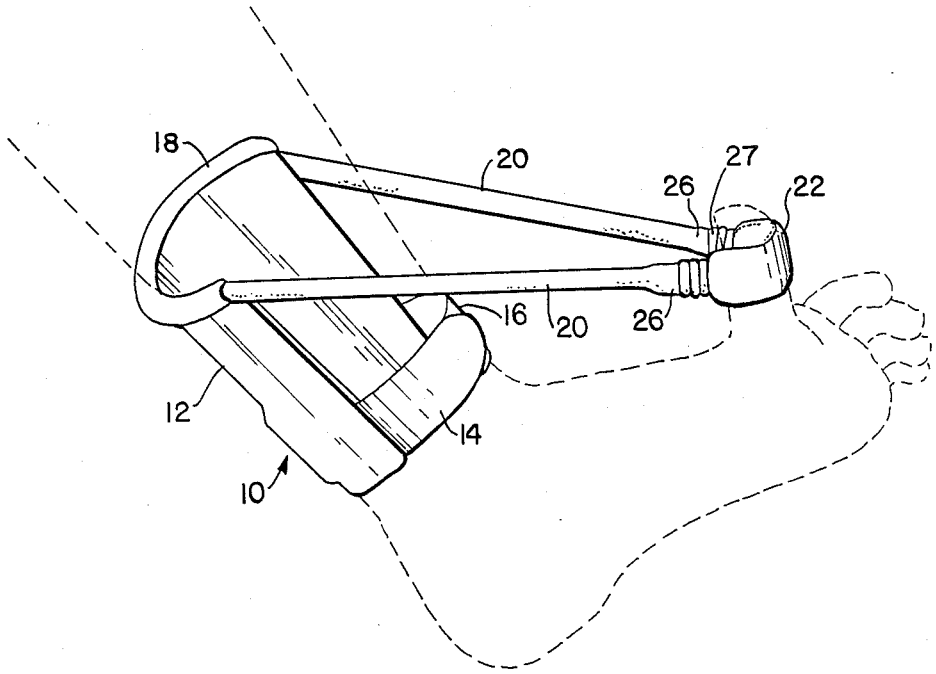
FIG. 1 is a perspective view of a toe exercise device constructed according to the present invention and mounted with the user's foot (shown in dotted lines) with the device being in an unstretched position.
Figure 2:
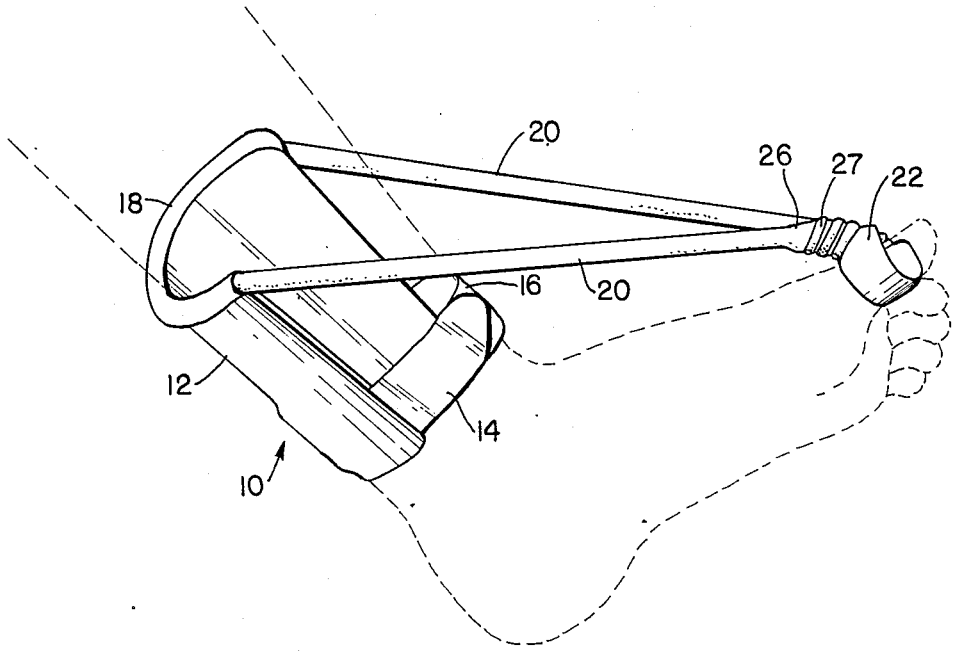
FIG. 2 is a perspective view of a toe exercise device constructed according to the present invention in combination with the user's foot showing the device in its stretched position.
Figure 3:
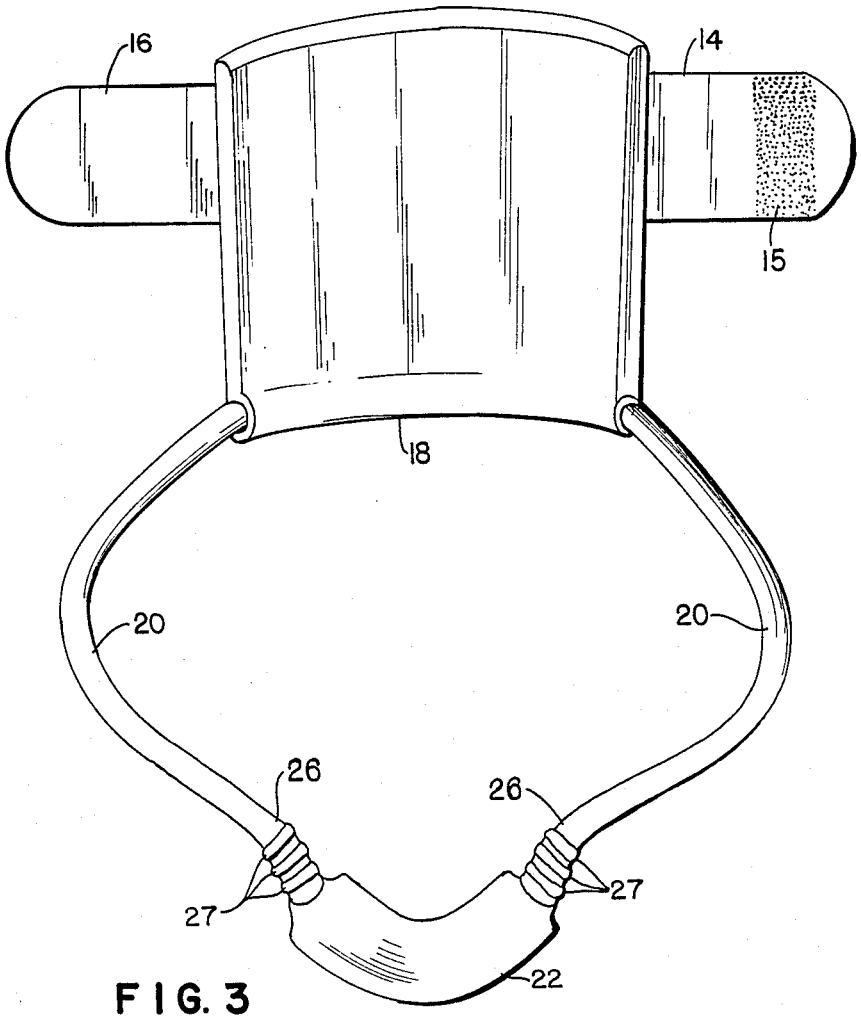
FIG. 3 is a front elevation view of the toe exercise device according to the present invention.
Figure 4:
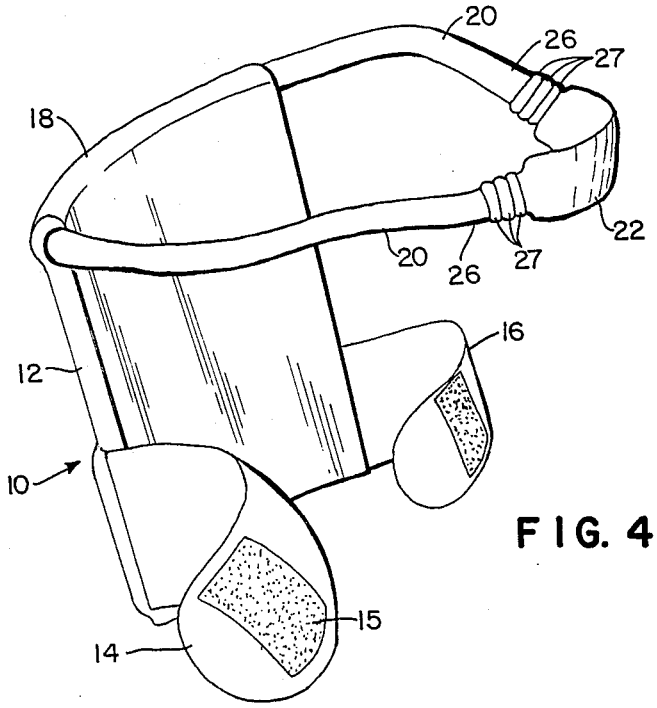
FIG. 4 is a side elevation view of the toe exercise device according to the present invention.

Referring now to the drawings wherein like parts are designated by the same reference numeral throughout the several views, there is illustrated in FIG. 1 a dynamic splint in the form of a toe exercise device generally designated 10 mounted about the portion of the user's leg directly above the ankle. The device comprises a semi-circular relatively stiff backing brace member 12 which may typically comprise a plastic shell which can be approximately 6" long or any other length depending upon the various sizes that one desires. The brace member is adapted to fit, as shown, behind the leg above the ankle of the user. At the bottom of the member are provided, as shown in FIGS. 1 through 6, adjustable holding strap means comprising a pair of holding straps 14, 16. These straps have cooperating hook and pile tape sold under the trademark "VELCRO" 15 associated with opposing surfaces at the end thereof such that the straps can be adjustably fitted across the front of the ankle portion of the user in order to hold the device in place. The straps may be held in place or secured with the brace member by a variety of suitable means such as stitching, rivots and the like. Other fastening means (e.g. snaps, buckle) than "VELCRO" also may be used. The upper end of the plastic shell has an elongated annular tubular opening formed as shown at 18 such that it is adapted to have rubber tubing 20 pass therethrough. According to the present invention, the rubber tubing will be secured in the tubular portion of the brace member 12 at the top and will have its free ends secured with a toe pouch or sling 22. FIG. 1 best illustrates the toe pouch or sling 22 fitted around the under side of the toe and urging the toe in the direction back toward the leg or body of the user.

The particular size of the sling may vary depending upon the size of the user and/or the particular toe being exercised.

Figure 5:
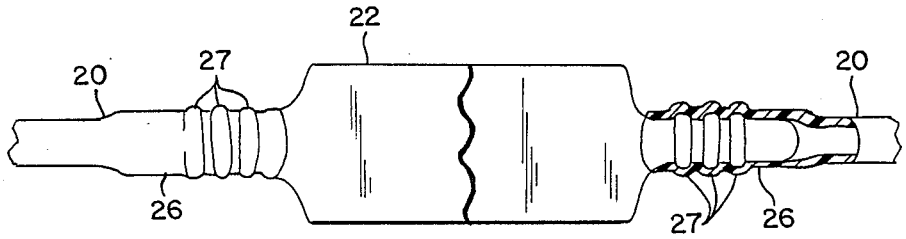
FIG. 5 is an enlarged view of the toe pouch or sling connected with the flexible tubing of the toe exercise device according to this invention.
Figure 6:
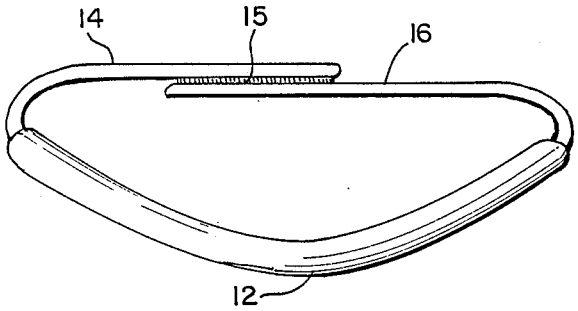
FIG. 6 is a bottom plan view of the toe exercise device constructed according to the present invention with the holding straps disposed in a closed position without the toe sling portion of the device.

The tubing length can be adjusted such that the toe being exercised will be pulled toward the user's leg when the device is applied. The toe sling also comprises a rubberlike material and can be of any size that would accommodate or correspond to the size of the particular toe of the user of the device. The sling is removably secured with the free ends of the tubing 20 as best shown in FIG. 5. Each toe sling has at its extreme ends a pair of connecting extensions 26 which are formed with a series of annular spaced ridges 27 which are adapted, when each extension is inserted into the corresponding free end of the rubber tubing 20, to suitably connect the pouch to the rubber tubing such that it will remain in place as the toe is being exercised. This also facilitates adjusting the tubing length (i.e., by cutting off the desired amount) to exert the appropriate tension on the toe. The secured connection between the pouch and the tubing is aided by having the sling made of the same material as the tubing which creates a higher frictional resistance between the two devices when the extensions are inserted into the free ends of the tubing. Other suitable means for connecting the toe sling to the tubing are possible such that the pouch will hold the toe toward the leg before the exercise begins.

Figure 7:
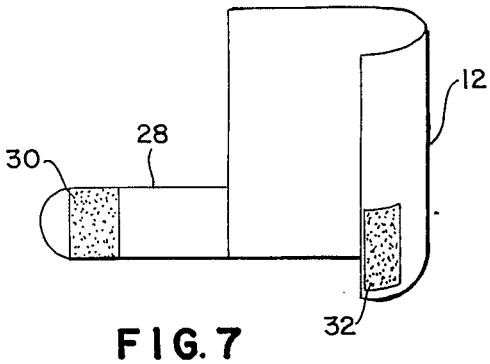
FIG. 7 shows an alternate embodiment of the present invention including a single holding strap for use with the present toe exercise device.

The preferred embodiment has been shown with holding strap means 14, 16 comprising a pair of similar holding straps extending from each side of the brace member at the bottom thereof. An alternate embodiment is shown in FIG. 7 with only a single holding strap. According to that embodiment, the single holding strap 28 has "VELCRO" material disposed on its inner surface at the end thereof as shown at 30. On the outer surface of the brace member adjacent the edge opposite the holding strap is additional "VELCRO" material shown at 32. Thus, when the single holding strap is placed across the front of the user's ankle, the "VELCRO" 30 engages the "VELCRO" 32 on the strap, thus holding the brace in place in a suitable fashion.

The present dynamic splint will assist in obtaining a passive extension of the first through fifth metatarsal phalangeal joints when applied to the toes. Normally, the splint is applied by the patient under the instruction and guidance of a physician or therapist. The splint would normally be used as part of and in conjunction with an exercise program. Typically, the device will enable a person who has injured his or her foot to exercise the tendons both behind as well as under the toe being exercised. The stretching of the tendons and the soft tissue in the same area will enable the person to resume walking in the normal manner. The particular tendons which are stretched are termed the flexor hallicus longus and flexor hallicus brevis in respect to the big toe, and the flexor digitorum longus and flexor digitorum brevis of the other toes.

It should be understood that, while there is disclosed a preferred embodiment of the present invention with certain alternate embodiments, the invention is subject to other variations, modifications and changes in details. Thus, for example, the device according to the present invention can be made in a variety of different sizes for example, small, medium and large. This can be accomplished by modifying the size of the brace member, modifying the strength of the rubber tubing, as well as the toe sling, in order to accommodate the toe size and strength of the user. Also, the tubing can be modified to accommodate the needs and strength of the user and can have variable different tension depending upon the type of rubber utilized. An additional variation is for the pouch to be designed to fit the ball of the foot to strengthen a weak ankle. It is intended, however, that all matter contained in the foregoing description and shown in the accompanying drawings shall be interpreted as illustrative only and not in a limiting sense.

What I claim is:

1. A toe exercise device for enabling an individual to exercise certain tendons in the vicinity of a toe of a person, comprising a substantially rigid semi-circular brace member curved along its longitudinal axis for its entire length and substantially conforming with the shape of the lower portion of the individual's leg and adapted to be secured in the vicinity in the rear portion of the leg directly above the ankle, holding means located at the bottom portion of said member adapted for holding the brace in place relative to the individual's leg and adjustably fitting across the front of said leg, and toe support means comprising stretchable tubing attached to the top end of said member, extending from the sides of said member, and having at its extreme end a flexible toe sling adapted for supporting the toe to be exercised, whereby the toe exercise device causes the toe disposed in said sling to be pulled toward the individual's leg.

2. The device of claim 1 wherein said brace member is formed of a substantially rigid plastic material.

3. The device of claim 1 wherein said holding means for releasably holding said brace in place comprises at least one strap operatively connected at the bottom of said brace member and having means associated therewith for making said holding means adjustable in size relative to the individual's leg.

4. The toe exercise device of claim 3 wherein said holding means comprises a pair of straps extending from opposite sides at the bottom of said brace member, each of said straps having means associated therewith for releasably engaging the other one of said straps to releasably secure said brace member relative to the leg of said individual.

5. The toe exercise of claim 1 wherein said brace member includes a tubular portion across the top thereof for holding said rubber tubing in place.

6. The toe exercise device of claim 1 wherein said holding means includes "VELCRO" disposed on opposed surfaces adapted for releasably holding said bracing member in place relative to the individual's leg.

* * * * *